US008936535B1

(12) United States Patent
Chen

(10) Patent No.: US 8,936,535 B1
(45) Date of Patent: Jan. 20, 2015

(54) ELLIPTICAL TRAINER

(71) Applicant: Healthstream Taiwan Inc., Jhongli, Taoyuan County (TW)

(72) Inventor: Chun-Ting Chen, Jhongli (TW)

(73) Assignee: Healthstream Taiwan Inc., Jhongli, Taoyaun County (TW)

( * ) Notice: Subject to any disclaimer, the term of this patent is extended or adjusted under 35 U.S.C. 154(b) by 20 days.

(21) Appl. No.: 13/974,724

(22) Filed: Aug. 23, 2013

(51) Int. Cl.
*A63B 22/00* (2006.01)
*A63B 23/12* (2006.01)
*A63B 22/06* (2006.01)

(52) U.S. Cl.
CPC ..... *A63B 22/0664* (2013.01)
USPC ..... 482/52; 482/51

(58) Field of Classification Search
CPC ..... A63B 22/0664; A63B 22/001; A63B 21/225; A63B 2022/067; A63B 22/0015
USPC ..... 482/52, 57, 51, 62
See application file for complete search history.

(56) References Cited

U.S. PATENT DOCUMENTS 6,063,008 A * 5/2000 McBride et al. ..... 482/52
6,183,398 B1 * 2/2001 Rufino et al. ..... 482/57
6,454,682 B1 * 9/2002 Kuo ..... 482/52
7,022,049 B2 * 4/2006 Ryan et al. ..... 482/51
7,223,209 B2 * 5/2007 Lee ..... 482/52
7,276,017 B2 * 10/2007 Chen ..... 482/52
7,736,278 B2 * 6/2010 Lull et al. ..... 482/52
8,308,617 B2 * 11/2012 Jhang et al. ..... 482/52
8,840,529 B2 * 9/2014 Chen ..... 482/52
8,870,716 B2 * 10/2014 Murray et al. ..... 482/51
2004/0053748 A1 * 3/2004 Lo et al. ..... 482/52
2004/0147375 A1 * 7/2004 Stevens ..... 482/57
2004/0157706 A1 * 8/2004 Miller ..... 482/52
2005/0026751 A1 * 2/2005 Lo ..... 482/52
2008/0274860 A1 * 11/2008 Lee ..... 482/52
2009/0069158 A1 * 3/2009 Hsu ..... 482/52

* cited by examiner

*Primary Examiner* — Stephen Crow
(74) *Attorney, Agent, or Firm* — Muncy, Geissler, Olds & Lowe, P.C.

(57) ABSTRACT

An elliptical trainer includes a frame, a handrail set, a flywheel set, and a pedal set. The frame has two opposing rails. The handrail set has two handrails pivotally connected to the frame. The bottom ends of the handrails are pivotally connected to handrail links. The rear end of each of the handrail links has a first guiding roller disposed at one of the rails. The flywheel set has a driving flywheel. The driving flywheel is flanked by two cranks each pivotally connected to a crank link. The front end of the crank link has a second guiding roller disposed at one of the rails. The pedal set has two opposing pedal links. Two ends of each of the pedal links are pivotally connected to the handrail links and the crank links, respectively. Pedals are fixed to the pedal links and follow stable motion paths to enable easy operation.

3 Claims, 6 Drawing Sheets

ELLIPTICAL TRAINER

BACKGROUND OF THE INVENTION

1. Technical Field

The present invention relates to fitness equipment, and more particularly, to an elliptical trainer with a stable motion path.

2. Description of Related Art

In general, a conventional elliptical trainer typically comprises a plurality of links connected to each other and operating in conjunction with each other to allow a user to tread on left and right pedals with the user's feet moving along an elliptical path, so as for the user to exercise the lower limbs in a manner to simulate walking, running, or walking upstairs. Hence, the motion paths of the two pedals depend on the journey of the links. The longer the motion paths of the two pedals are, the higher is the intensity of the training received by the user.

However, some conventional elliptical trainers are designed to manifest a considerable difference in the height of the motion paths of the left and right pedals moving to and fro, in order to meet a specific requirement for overall structural arrangement, or because of technological limitations. As a result, users not only find it exhausting to operate the conventional elliptical trainers, but are also likely to get sports injuries caused by long use of the conventional elliptical trainers.

SUMMARY OF THE INVENTION

It is an objective of the present invention to provide an elliptical trainer characterized by a stable motion path conducive to enhancement of ease of operation.

In order to achieve the above and other objectives, the present invention provides an elliptical trainer which comprises a frame, a handrail set, a flywheel set, and a pedal set. The frame has a base and two opposing rails which flank the base. The handrail set has two opposing handrails and two opposing handrail links. The handrails are each pivotally connected to the front end of the frame. The front end of each of the handrail links is pivotally connected to the bottom end of a corresponding one of the handrails. The rear end of each of the handrail links has a first guiding roller. The first guiding rollers are rollably disposed at the rails of the frame, respectively. The flywheel set has a driving flywheel, two opposing cranks, and two opposing crank links. The driving flywheel is disposed spinningly at the rear end of the frame and connected to the rear end of each of the cranks. The front end of each of the cranks is pivotally connected to a rear end of a corresponding one of the crank links. The second guiding roller is disposed at the front end of each of the crank links and disposed rollably at each of the rails of the frame. The pedal set has two opposing pedal links and two opposing pedals. The front and rear ends of each of the pedal links are pivotally connected to a corresponding one of the handrail links and a corresponding one of the crank links, respectively. The pedals are each fixed to the top side of a corresponding one of the pedal links. Hence, with a user treading the pedals, the handrails swing forward and backward synchronously, and the flywheel spins, thereby allowing the pedals to move along elliptical paths steadily.

In the embodiment of the present invention, the flywheel set further has a driven flywheel and a first conveyor belt, the driven flywheel being disposed spinningly at the rear end of the frame, and the first conveyor belt being adapted to connect the driving flywheel and the driven flywheel, so as to enable stable transmission.

In the embodiment of the present invention, the flywheel set further has a wheel seat, a magnetic reluctance wheel, and a second conveyor belt, the wheel seat being fixed to the base of the frame, the magnetic reluctance wheel being disposed spinningly at the wheel seat, and the second conveyor belt being adapted to connect the driven flywheel and the magnetic reluctance wheel, so as to provide appropriate resistance and thereby increase a user's training intensity.

DETAILED DESCRIPTION OF THE EMBODIMENT OF THE INVENTION

Figure 1:
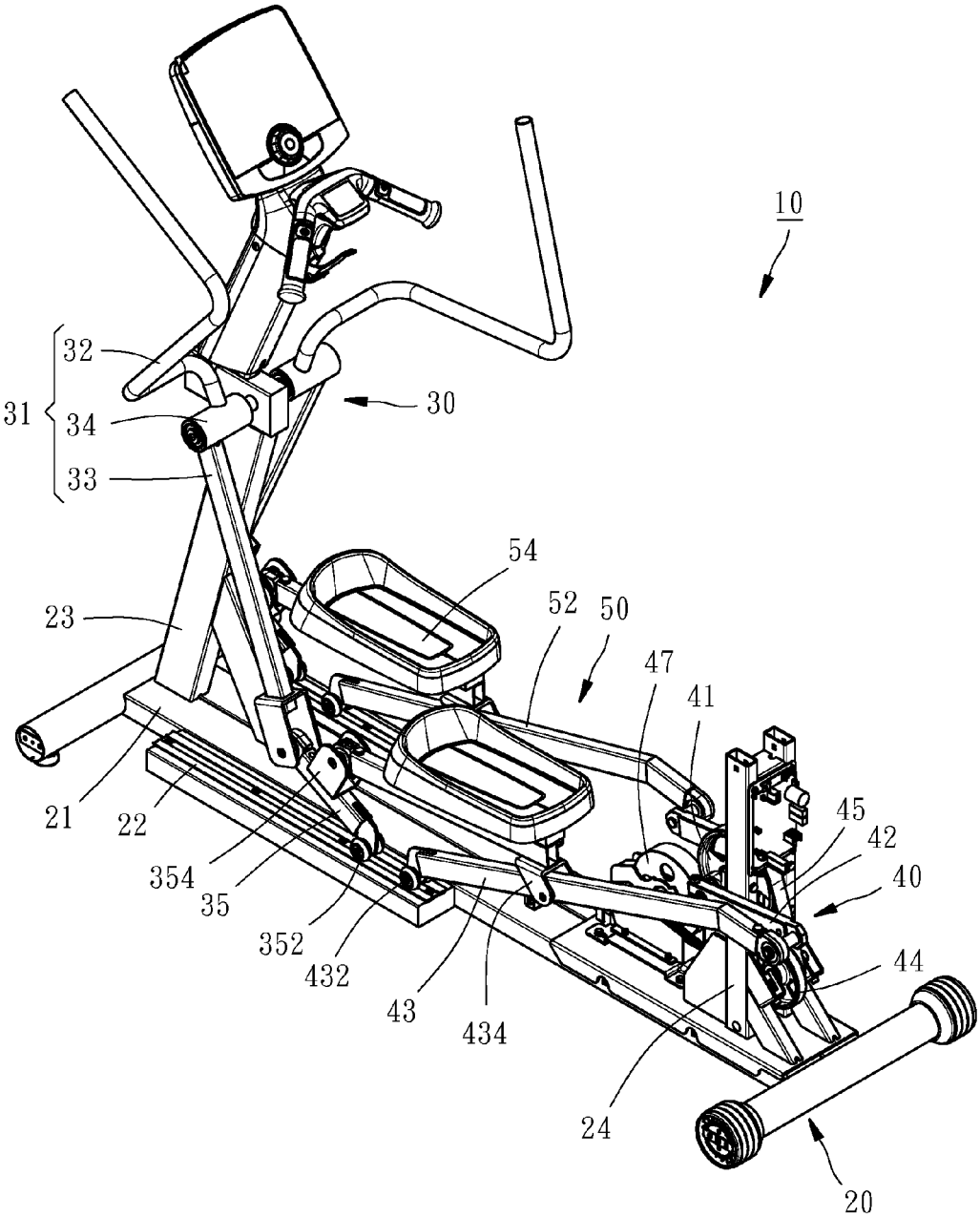
FIG. 1 is a perspective view of an elliptical trainer according to the present invention.
Figure 2:
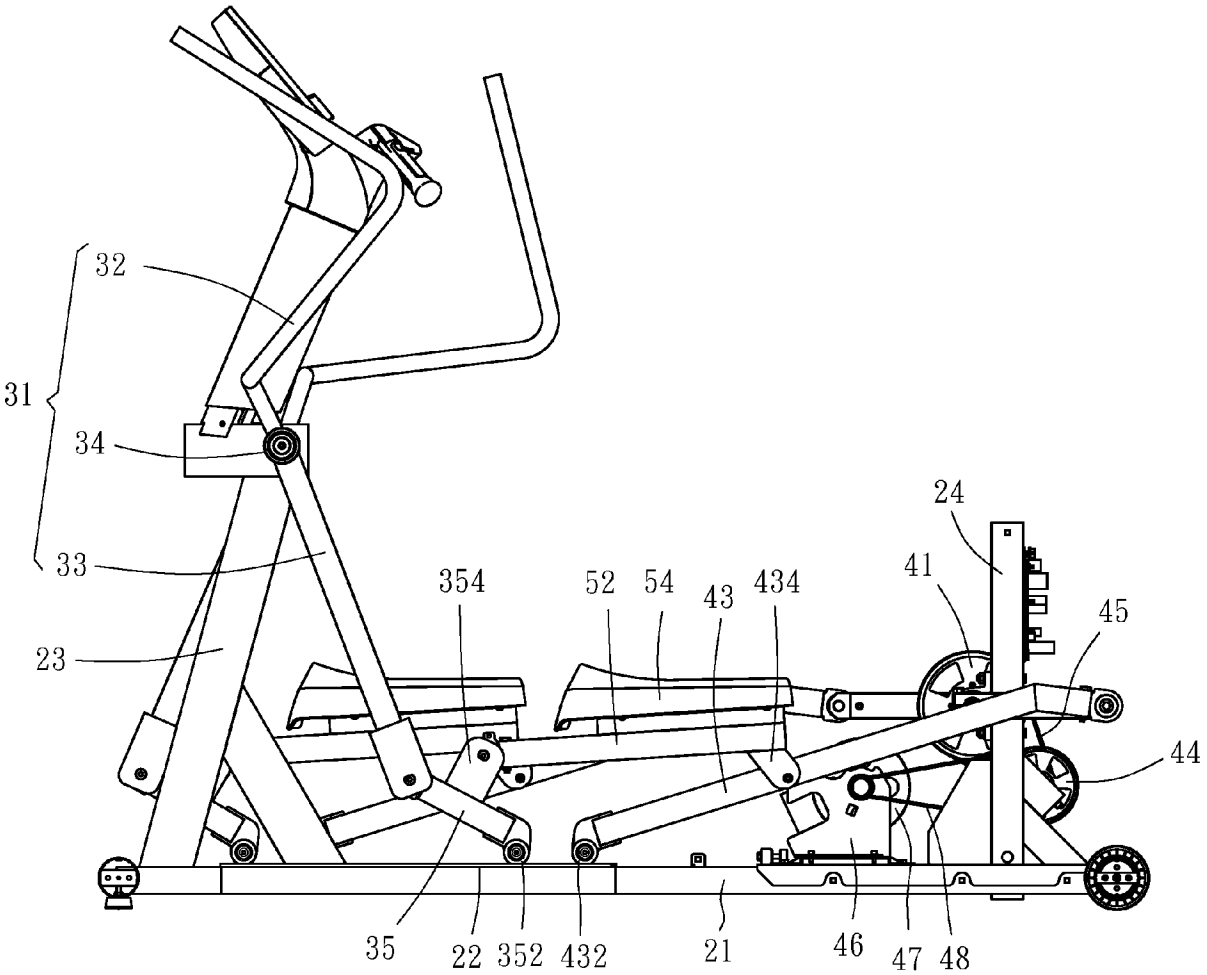
FIG. 2 is a lateral view of the elliptical trainer according to the present invention.

Referring to FIG. 1 and FIG. 2, an elliptical trainer 10 of the present invention comprises a frame 20, a handrail set 30, a flywheel set 40, and a pedal set 50.

The frame 20 has a base 21 and two rails 22. The two rails 22 flank the base 21. The frame 20 further has a front upright post 23 and a rear upright post 24. The front and rear upright posts 23, 24 are fixed upright to front and rear ends of the base 21, respectively.

The handrail set 30 has two opposing handrails 31 and two opposing handrail links 35. The handrails 31 each have a handrail rod 32, a swing bar 33, and a connection spindle 34. The connection spindle 34 is connected between the handrail rod 32 and the swing bar 33 and pivotally connected to the front upright post 23 of the frame 20. The front end of the handrail links 35 is pivotally connected to the bottom end of the swing bar 33 of the handrails 31. The rear end of each of the handrail links 35 has a first guiding roller 352. The first guiding rollers 352 are engaged with the rails 22 of the frame 20 and roll along the rails 22, respectively, forward and backward. A first pivotal connection element 354 is disposed on the top side of each of the handrail links 35.

Figure 3:
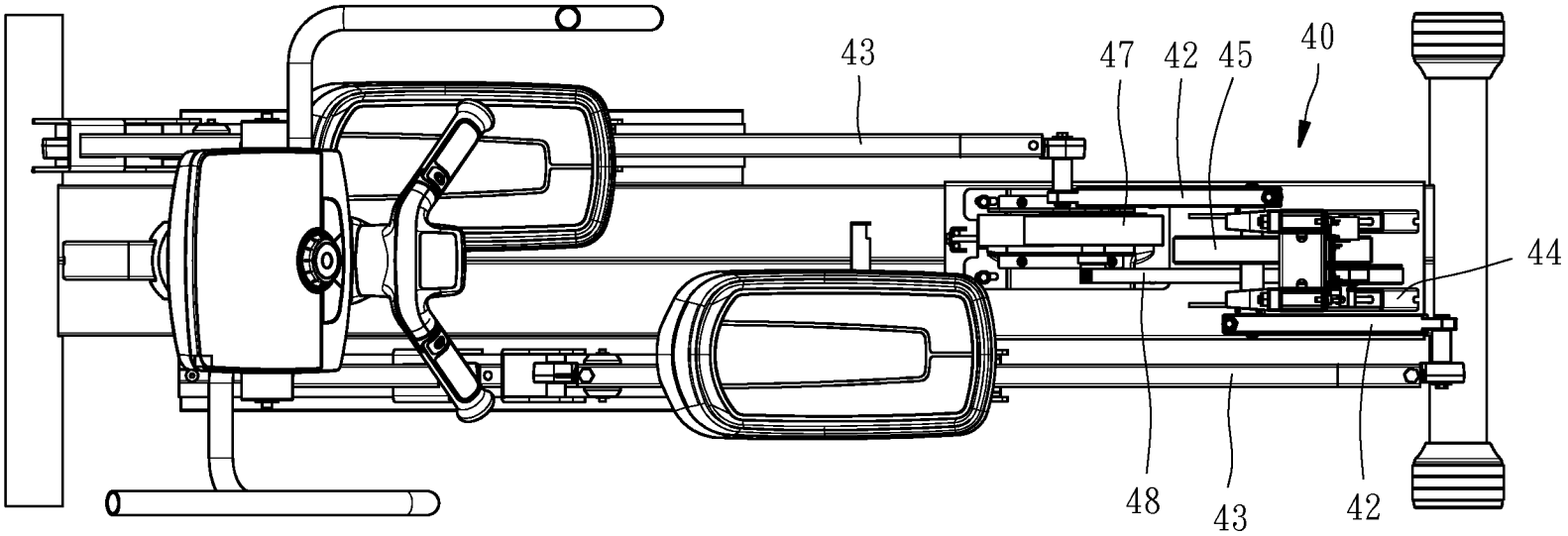
FIG. 3 is a top view of the elliptical trainer according to the present invention.

Referring to FIG. 2 and FIG. 3, the flywheel set 40 has a driving flywheel 41, two opposing cranks 42, two opposing crank links 43, a driven flywheel 44, and a first conveyor belt 45. The driving flywheel 41 is disposed spinningly at the rear upright post 24 of the frame 20. The rear end of each of the cranks 42 is connected to the center of the driving flywheel 41. The front end of each of the cranks 42 is pivotally connected to the rear end of a corresponding one of the crank links 43. The front end of each of the crank links 43 has a second guiding roller 432. The second guiding rollers 432 are disposed at the rails 22 of the frame 20 and roll along the rails 22, respectively, forward and backward. A second pivotal connection element 434 is disposed on the top side of each of the crank links 43. The driven flywheel 44 is disposed spinningly at the rear upright post 24 of the frame 20. The first conveyor belt 45 is not only disposed at and wound around the driving flywheel 41 but also connected to the driven flywheel 44, such that the driving and driven flywheels 41, 44 spin synchronously. The flywheel set 40 further has a wheel seat 46, a magnetic reluctance wheel 47, and a second conveyor belt 48. The wheel seat 46 is fixed to the base 21 of the frame 20 and positioned in front of the driving flywheel 41. The magnetic reluctance wheel 47 is disposed spinningly at the wheel seat 46 and adapted to provide appropriate resistance. The second conveyor belt 48 connects the driven flywheel 44 and the magnetic reluctance wheel 47, such that the driven flywheel 44 and the magnetic reluctance wheel 47 spin synchronously.

The pedal set 50 has two opposing pedal links 52 and two opposing pedals 54. The front and rear ends of each of the pedal links 52 are pivotally connected to the first pivotal connection element 354 of a corresponding one of the handrail links 35 and the second pivotal connection element 434 of a corresponding one of the crank links 43, respectively. The pedals 54 are fixed to the top sides of the pedal links 52, respectively, such that a user can tread on the pedals 54.

Figure 4:
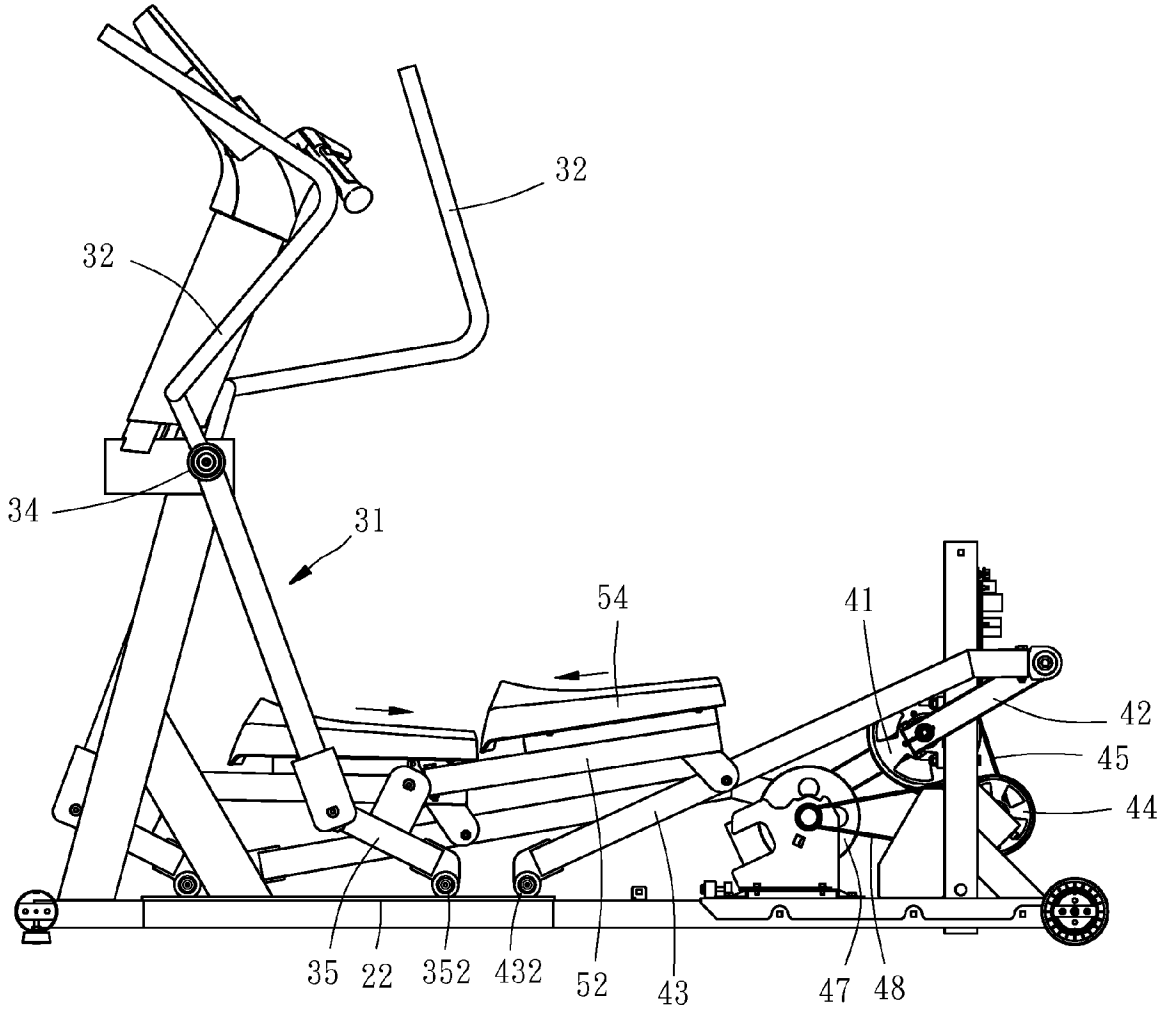
FIGS. 4-6 are lateral views of the elliptical trainer in operation according to the present invention.
Figure 5:
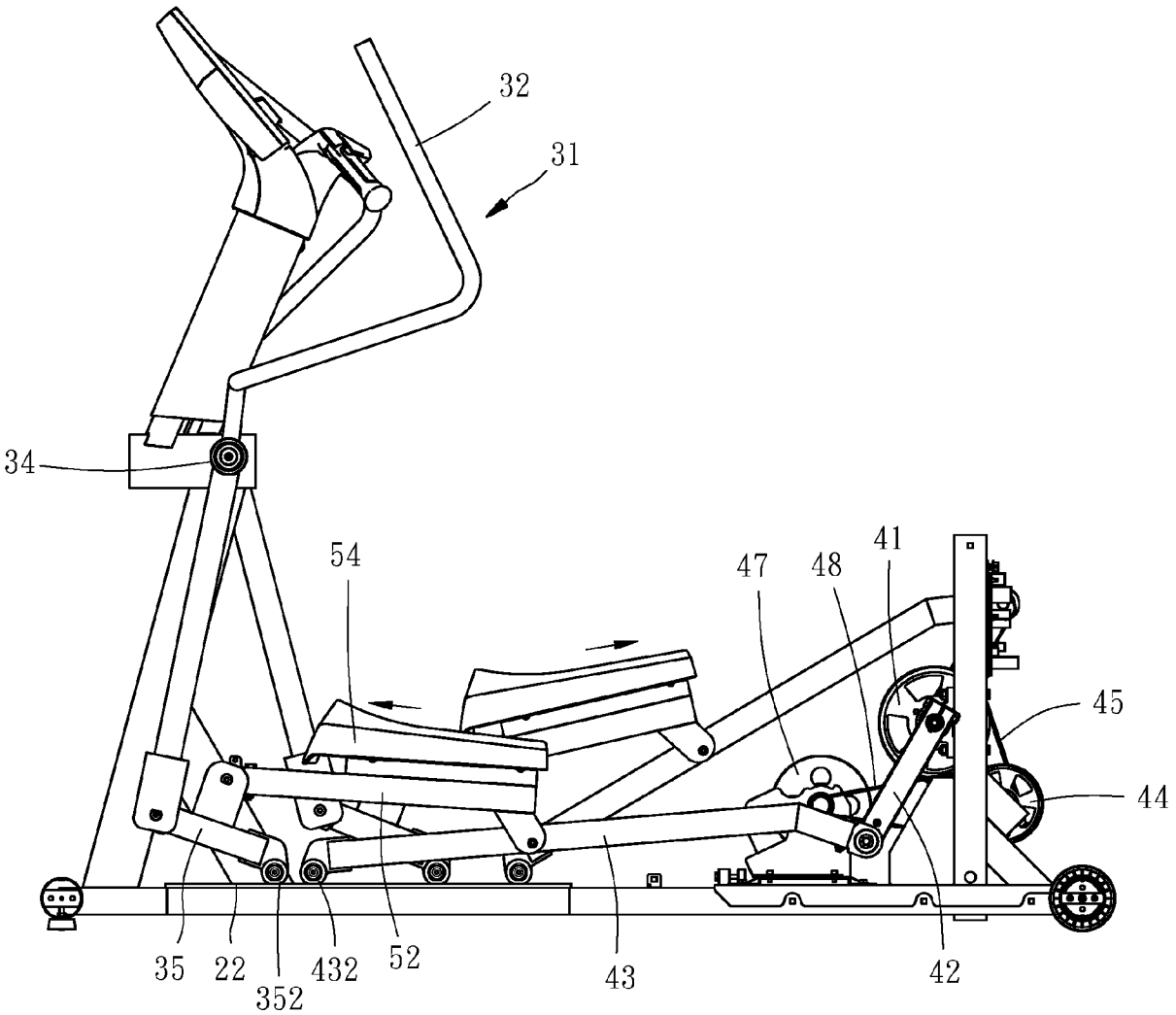
Figure 6:
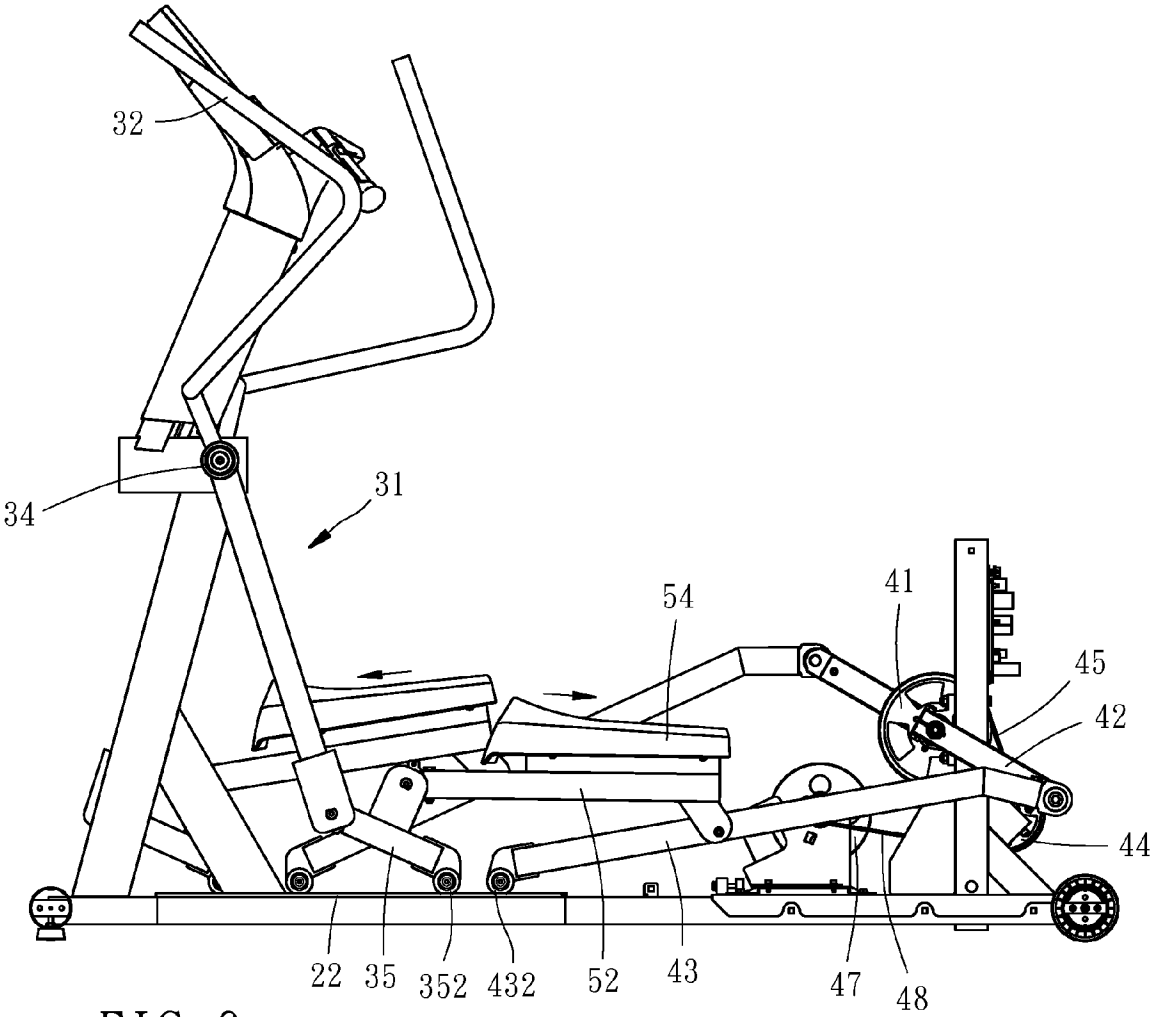

Referring to FIGS. 4-6, the user can start to tread on the pedals 54, as soon as the user stands on the pedals 54 and grips the two handrail rods 32. The course of the forward motion of the pedals 54 features two simultaneous phenomena. First, the front ends of the pedal links 52 push the handrail links 35 to cause the handrails 31 to swing forward while rotating about the connection spindle 34, and the first guiding rollers 352 of the handrail links 35 roll forward along the rails 22, respectively. Second, the rear ends of the pedal links 52 pull the crank links 43 to cause the second guiding rollers 432 of the crank links 43 to roll forward along the rails 22, respectively; meanwhile, the cranks 42 are driven by the crank links 43 to drive the driving flywheel 41 to spin. Afterward, the driving flywheel 41 is driven by the first conveyor belt 45 to drive the driven flywheel 44 to spin. Eventually, the driven flywheel 44 is driven by the second conveyor belt 48 to drive the magnetic reluctance wheel 47 to spin.

However, in the course of backward motion of the pedals 54, the front ends of the pedal links 52 pull the handrail links 35 to not only cause the handrails 31 to swing backward while rotating about the connection spindle 34 but also cause the first guiding rollers 352 of the handrail links 35 to roll backward along the rails 22, respectively, whereas the rear ends of the pedal links 52 push the crank links 43 to cause the second guiding rollers 432 of the crank links 43 to roll backward along the rails 22, respectively, and drive the cranks 42 to drive the driving flywheel 41 to spin; meanwhile, the driven flywheel 44 and the magnetic reluctance wheel 47 spin synchronously. Hence, when being trodden by the user continuously, the pedals 54 follow elliptical motion paths until the user's training need is met.

In conclusion, according to the present invention, the elliptical trainer 10 in operation does not manifest a considerable difference in the height of the motion paths of the left and right pedals and thus has stable motion paths conducive to enhancement of ease of operation and reduction of sports injuries. Therefore, the elliptical trainer 10 is suitable for users of all age groups.

What is claimed is:

1. An elliptical trainer, comprising:

a frame having a base and two rails flanking the base;

a handrail set having two opposing handrails and two opposing handrail links, the handrails each being pivotally connected to a front end of the frame, wherein a front end of each of the handrail links is pivotally connected to a bottom end of a corresponding one of the handrails, and a rear end of each of the handrail links has a first guiding roller, such that the first guiding rollers are disposed rollably at the rails of the frame, respectively;

a flywheel set having a driving flywheel, two opposing cranks, and two opposing crank links, the driving flywheel being disposed spinningly at a rear end of the frame and connected to a rear end of each of the cranks, wherein a front end of each of the cranks is pivotally connected to a rear end of a corresponding one of the crank links, and a second guiding roller is disposed at a front end of each of the crank links and disposed rollably at each of the rails of the frame; and a pedal set having two opposing pedal links and two opposing pedals, wherein front and rear ends of each of the pedal links are pivotally connected to a corresponding one of the handrail links and a corresponding one of the crank links, respectively, and the pedals are each fixed to a top side of a corresponding one of the pedal links.

2. The elliptical trainer of claim 1, wherein the flywheel set further has a driven flywheel and a first conveyor belt, the driven flywheel being disposed spinningly at the rear end of the frame, and the first conveyor belt being adapted to connect the driving flywheel and the driven flywheel.

3. The elliptical trainer of claim 2, wherein the flywheel set further has a wheel seat, a magnetic reluctance wheel, and a second conveyor belt, the wheel seat being fixed to the base of the frame, the magnetic reluctance wheel being disposed spinningly at the wheel seat, and the second conveyor belt being adapted to connect the driven flywheel and the magnetic reluctance wheel.

* * * * *